United States Patent [19]

Strahm et al.

[11] 4,335,593

[45] Jun. 22, 1982

[54] CHAINLESS MERCERIZING EQUIPMENT USING A DYE PADDER

[75] Inventors: Christian Strahm, Küsnacht, Switzerland; Werner Strudel, Friedrichshafen, Fed. Rep. of Germany

[73] Assignee: Lindauer Dornier Gesellschaft mbH, Fed. Rep. of Germany

[21] Appl. No.: 188,289

[22] Filed: Sep. 18, 1980

[30] Foreign Application Priority Data

Oct. 9, 1979 [DE] Fed. Rep. of Germany ..... 2940867

[51] Int. Cl.[3] ..... D06B 7/08; D06B 7/10

[52] U.S. Cl. ..... 68/13 R; 68/22 R

[58] Field of Search ..... 68/9, 13 R, 19.1, 20, 68/22 R, 43

[56] References Cited

U.S. PATENT DOCUMENTS

| | | | |
|---|---|---|---|
| 2,239,636 | 4/1941 | Weiss | 68/13 R X |
| 2,693,995 | 11/1954 | Hannay et al. | 68/13 R X |
| 3,263,458 | 8/1966 | Cohn et al. | 68/22 R |
| 3,546,901 | 12/1970 | Fleissner | 68/DIG. 5 |
| 3,646,785 | 3/1972 | Arioli | 68/9 X |
| 3,719,062 | 3/1973 | Fleissner | 68/9 X |
| 4,112,532 | 9/1978 | Catallo | 68/13 R X |

*Primary Examiner*—Philip R. Coe

*Attorney, Agent, or Firm*—James E. Bryan

[57] ABSTRACT

This invention relates to an improvement in chainless mercerizing equipment for the selective processing of flat textiles and hose ware using a mercerizing dye padder provided with rollers, the material being guided over mercerizing rollers through a bath of a treatment liquid and the excess treatment liquid being forced out of the material by a subsequent pair of rollers, and the material then being washed, the improvement comprising (a) selective feed path means preceding the dye padder from a common site, said paths including different expander means for flat textiles and hose ware, (b) a clear space for moving in and out a batching or cuttling means for the flat textiles and means for guiding the material to the batching or cuttling means, and (c) an air passage means spanning the clear space and acting as a development path for the hose ware, followed by a treatment means provided with at least one circular expander and bounding the clear space, and a subsequent cuttling means.

11 Claims, 1 Drawing Figure

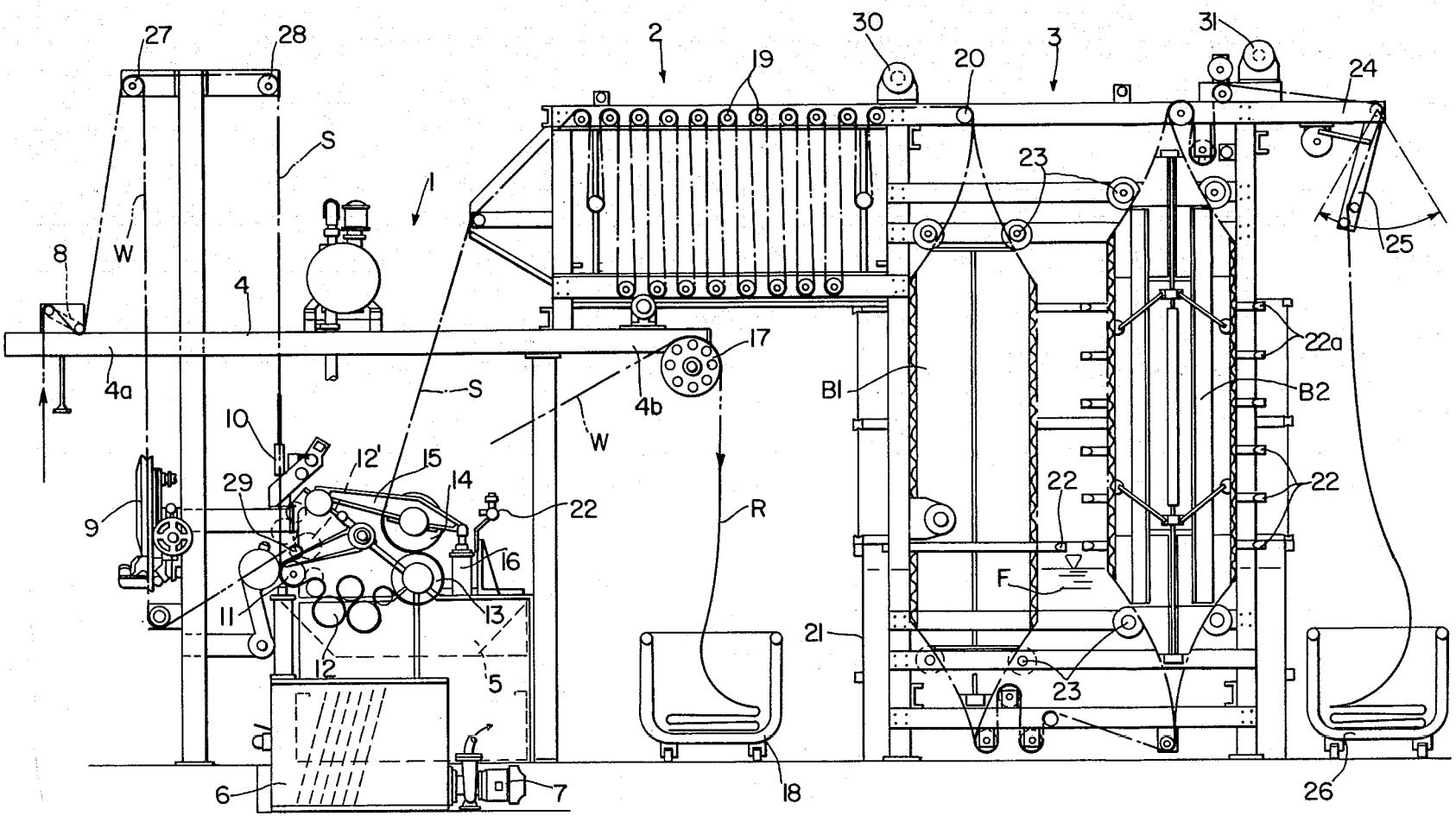
1
2
3
4
4a
4b
5
6
7
8
9
10
11
12
12'
13
14
15
16
17
18
19
20
21
22
22a
23
24
25
26
27
28
29
30
31
B1
B2
F
R
S
W

CHAINLESS MERCERIZING EQUIPMENT USING A DYE PADDER

This invention relates to chainless mercerizing equipment for the selective processing of flat goods and tubular wares using a dye padder equipped with rollers for mercerizing.

Mercerization already long ago assumed a significant role in textile finishing. The most varied kinds of mercerizing equipment are known, for instance those operating with revolving endless chains, and also machinery without chains. The type of guidance provided for the ware is also one of the significant factors in mercerizing equipment. As a rule a constrained guidance is desired so that the ware does not shrink excessively. Both kinds of mercerizing equipment, both that operating with chains and that without, ordinarily operate continuously, that is, the ware constantly moves through the various successive treatment stages such as impregnation with the treatment liquid, action time, stabilization and washing, and possibly drying. This type of mercerizing equipment therefore is rather bulky and especially so when using chains.

Another type of mercerizing equipment operates intermittently and uses a dye padder with rollers one above the other. The lower roller is designed as the drive roller and the upper one as the squeezing roller. A set of mercerizing rollers precedes the first cited pair of rollers and also dips more or less like the drive roller into the bath of the treatment liquid. In operation, the ware guided over the mercerization rollers and the drive roller through the impregnating bath is wound on the squeezing roller in the case of the mercerizing dye padder, and the excess treatment liquid is thus squeezed out. This is followed by an action time as long as the ware is wound on the squeezer roller. The ware is wholly outside the impregnation bath in that case. Thereupon the ware is taken off the squeezing roller and is wound again in the opposite direction onto the drive roller, the mercerizing rollers being lifted off of the drive roller. The impregnation liquid during this process is evacuated from the container and instead warm water is sprayed against the ware, which is washed in this manner. After completion of the rewinding and rinsing of the ware, a new reversal in direction takes place and the ware again is taken off in the direction of the squeezer roller. In the process, the ware is sprayed off again. In this process, the ware no longer is wound on the squeezer roller, rather it is made to pass from it to a batching or cuttling device. As from the entry to the mercerizing dye padder above the mercerizing rollers the drive roller and the squeezer roller follow the individual rollers very tightly or rest against them, there is a constrained guidance of the ware along the entire path of treatment.

Mercerizing equipment of this kind is substantially more compact than the initially cited continuously mercerizing equipment, and most significantly also more economical because it requires a substantially lesser amount of liquid in the impregnation bath. This may become a significant factor as regards a rapid change in liquor or in bath concentration. Again the lesser content is an advantage regarding cooling of the bath, and thereby substantially fewer problems are encountered. In this regard also there is an improvement in economics. This type of mercerizing equipment is practical for open or flat textiles, and also has been used for tubular wares. As regards hose ware, its impregnation with the treatment liquid during motion over the mercerizing rollers and the drive roller of the dye padder causes no difficulties, however in intermittent operation, ware stabilization and washing when unwinding and winding again will not take place evenly on both sides of the hose because the sprayed-on washing liquid is hampered when penetrating through the hose ware. Furthermore, marks are easily left on the ware when squeezing off the excess treatment liquid, especially at the pleats at the hose edge.

It is the object of the invention to so improve a known mercerizing dye padder that selectively flat or tubular textiles can be processed and that hose also can be treated in satisfactory manner. The problem is solved by the invention in that (a) upstream of the dye padder, selectable supply paths issuing from a common site are provided, with different expander means for flat and hose wares, (b) a clear space is provided at the exit of the dye padder for the introduction or removal of a batching or a cuttling device to guide the ware to the batching or cuttling device respectively, and (c) an air passage is provided spanning the clear space and acting as a development path for the hose ware, the passage being followed by a treatment unit bounding the clear space and provided with at least one round expanding means and followed by a cuttling frame.

In this manner, a satisfactory introduction of the various kinds of wares and their expansion up to the entry of the mercerizing rollers in the dye padder and hence also a constrained guidance are ensured. Flat textiles can be treated intermittently in conventional manner, whereas continuous treatment is possible for tubular wares without thereby having to forego the advantages of mercerizing dye padders.

An illustrative embodiment of the invention is explained below in relation to the drawing.

The mercerizing equipment contains three essential parts, namely the dye padder 1, an air passage 2 and a treatment unit 3. The dye padder 1 is mounted within a frame structure 4 at the top of which two arms 4*a* and 4*b* project forwardly and rearwardly. The forwardly projecting arm 4*a* is the support means for the feed devices of the ware to be treated and comprises a tensioning bar 8. The other arm 4*b* is a support means for the air passage 2 and a reel 17 for depositing the ware. A clear space R is formed underneath the arm 4*b*, i.e., the air passage 2, which space is bounded on one side by the dye padder 1 and on the other by the treatment unit 3. A cuttling cart 18, for instance, can be moved into this space R for receiving the ware coming from the reel 17.

The dye padder 1 is of known design. It contains an intake roller 11 and several mercerizing rollers 12. The first two mercerizing rollers forming the entry pair are designed as an air squeegee; their gap essentially is located in the liquid level of the mercerizing liquor. In this manner, when the ware, especially hose, passes from the air into the liquor, the air is removed from the ware and a better effect of the liquor on the ware is made possible. The last mercerizing roller rests against the next dye padder roller 13, and the mercerizing rollers dip at least partially and intermittently into the mercerizing liquid in the mercerization container 5. The dye padder roller 13 is designed as a drive roller and a squeezing roller 14 is mounted above it. The squeezing roller 14 can be lifted off of the drive roller 13 and is supported in rotatable manner for instance on a pivotal arm 15, the lifting motion off of the drive roller 13 being effected, for instance, by adjusting a lifting means 16 designed as a pneumatic cylinder. Futhermore, the spray nozzles 22 are mounted approximately at the level of the squeezing roller 14. The ware is prewashed by means of these nozzles 22 during the initially mentioned rewinding of the ware for the intermittent mode. A cooling vessel 6 and a pumping means 7 are further indicated underneath the mercerizing container 5, whereby the initially described intermittent mercerizing process is carried out.

As explained above, the mercerizing equipment is intended to be used both in the intermittent mode for flat textiles and in the continuous mode for hose ware. To that end, the supply paths are divided in the ware feed behind the adjustable tensioning bar 8. Open flat textiles W, represented in the drawing as a double-dot dashed line, are fed behind the tensioning bar 8 over a deflection cylinder or roller 27 in known manner to an expander 9. From there, the ware passes over an expander or deflecting roller 29 and over the intake roller 11 and arrives at the mercerizing section of the mercerizing rollers 12. The deflecting or expanding roller 29 and the intake roller 11 need not always be used together, on the contrary it is quite possible to make use of them individually and separately or in an integrated manner. The intermittent operation with its reversal in the winding direction and with its prewashing stage was described initially. In that process, the mercerizing rollers 12 are intermittently pivoted out of their position abutting the driver roller 13 and are moved into position 12' indicated in phantom. The open flat ware W is guided further on in the original direction of motion, once the second reversal of the winding direction has taken place, without further rewinding on the squeezing roller 14, moving directly to the reel 17 from where it is fed in conventional manner to a cuttling cart 18 moved into the space R.

As regards continuous operation with hose ware, the invention provides another feed path to the mercerizing unit. The path of the hose S is indicated by single dot-dash lines in the drawing. The hose ware S is guided from the tensioning bar 8 over a deflecting cylinder or roller 28 and from there it is moved over a known expander 10 to the intake roller 11 of the dye padder. The expander roller 29 in this process is moved into the inoperative position and remains out of contact with the ware. The flat expander 10 is so arranged in position that it rests against the intake roller 11 immediately prior to the introduction of the ware. In the further course of the process, the hose S is guided over the mercerizing rollers 12, the drive roller 13 and the squeezing roller 14 of the dye padder, however no winding on the squeezing roller 14 takes place. The ware passes from the squeezing roller 14 directly into the air passage 12 and its guidance rollers 19. The rollers of the pair of rollers composed of the drive and squeeze rollers 13 and 14 installed in the dye padder are provided with an adjustable gap in the last-cited mode to prevent that squeezing marks remain on the ware S when squeezing out the excess treatment liquid. To this end, the squeezing roller 14 is made liftable, for instance by means of the pivot arm 15 and the lift system 16, the lifting motion being away from the drive roller 13. The time during which the ware is made to pass over the rollers 19 of the air passage 2 suffices for adequate action of the treatment liquid on the ware S. To achieve defect-free treatment of the ware in the air passage 2, at least part of the guide rollers 19 are driven in synchronism. This drive is indicated in the drawing by the drive system 30.

Washing of the hose ware S is made possible in a subsequent treatment unit 3 by using a known circular expander B1 mounted in a container 21, with uniform expansion and circularity, shrinking of the material being avoided. The treatment unit 3 is not part of the present invention and therefore its design and operation is not further discussed. In the treatment unit also, special measures such as a special design of the support and transport rollers 23 ensure elimination of squeezing marks in the ware from the circular expander B1. The circular expander B1 dips at least in part into a treatment medium, for instance a washing liquid F, and furthermore it is possible to spray the ware from the outside. To that end, the spray nozzles 22 may be mounted around the circular expander B1. Furthermore, a second circular expander B2 may be provided in the treatment unit 3, which also dips into the washing liquid F and contains additional spray nozzles 22 for washing. Where appropriate, the circular expander B2 may be supplemented with a connecting drying operation by means of the air nozzles **22*a*. From the treatment unit 3, the hose ware S is guided over deflection rollers, for instance, toward a cuttling system 25 mounted to one arm 24 of the frame and feeding the ware for further transportation to a transport cart 26. The drive for transporting the ware over the circular expanders B1 and B2 and the drive for the cuttling system 25 is indicated by the drive unit 31**.

When passing from a treatment procedure for open flat textiles in the intermittent mode to treating hose ware in the continuous mode, no more is required therefore than to guide the ware over another feed roller 28 and the flat expander 10, the expander roller 29 being by-passed. It is not necessary in this operation to reverse the take-off directions of the dye padder rollers, i.e., drive roller 13 and squeezing roller 14.

On account of its design, the entire mercerizing equipment is composed of a compact frame structure around the dye padder as the support for the feed expander and the air passage, and this equipment further offers short paths for guiding the ware. It again makes possible a simple further conveyance of the ware to any subsequent treatment procedures as the required transport carts can be easily moved into the proper position, and as there are no unnecessary long paths for feeding the ware to the conveyor carts.

It will be obvious to those skilled in the art that many modifications may be made within the scope of the present invention without departing from the spirit thereof, and the invention includes all such modifications.

What we claim is:

1. In chainless mercerizing equipment for the selective processing of flat textiles and hose ware using a mercerizing dye padder provided with rollers, the material being guided over mercerizing rollers through a bath of a treatment liquid and the excess treatment liquid being forced out of the material by a subsequent pair of rollers, and the material then being washed, the improvement comprising (a) selective feed path means preceding the dye padder from a common site, said paths including different expander means for flat textiles and hose ware respectively, (b) a clear space for moving in and out a batching or cuttling means for the flat textiles and means for guiding the material from the dye padder to the batching or cuttling means, and (c) an air passage means spanning the clear space and acting as a development path for the hose ware, followed by a treatment means provided with at least one circular expander and bounding the clear space, and a subsequent cuttling means, and means for guiding said hose ware from the dye padder to said cuttling means.

2. Chainless mercerizing equipment according to claim 1 including means whereby a squeezing roller of a pair of dye padder rollers can be lifted as a function of its wound diameter from a drive roller of the pair of dye padder rollers.

3. Chainless mercerizing equipment according to claim 1 in which the dye padder includes a group of mercerizing rollers preceding a drive roller with one of said mercerizing rollers resting thereagainst, and being pivotal in common out of this position.

4. Chainless mercerizing equipment according to claim 1 including means whereby a gap width of the mercerizing rollers is adjustable.

5. Chainless mercerizing equipment according to claim 1 in which at least one of an input pair of rollers of the mercerizing rollers is designed as an air squeegee.

6. Chainless mercerizing equipment according to claim 5 in which a gap of the air squeegee is essentially located in the liquid level of the treatment liquid.

7. Chainless mercerizing equipment according to claim 1 in which the flat expander guides the hose ware with the least separation to an intake roller.

8. Chainless mercerizing equipment according to claim 1 including means driving at least part of rollers forming the air passage in synchronism.

9. Chainless mercerizing equipment according to claim 1 in which the treatment means is designed as a washing unit.

10. Chainless mercerizing equipment according to claim 9 in which the washing unit is followed by a drying unit.

11. Chainless mercerizing equipment according to claim 1 including a frame structure enclosing the dye padder with arms projecting on one side as supports for feed means and with arms projecting on the other side as supports for the air passage.

* * * * *